US012037786B2

(12) United States Patent
Frederico

(10) Patent No.: US 12,037,786 B2
(45) Date of Patent: Jul. 16, 2024

(54) ARRANGEMENT APPLIED TO MODULAR BLOCK WITH WEDGE-LIKE COUPLINGS

(71) Applicants: Bruno Abramo Frederico, Cotia-SP (BR); Bruno Martini Frederico, São Paulo-SP (BR)

(72) Inventor: Bruno Abramo Frederico, Cotia-SP (BR)

(73) Assignees: Bruno Abramo Frederico, Cotia-SP (BR); Bruno Martini Frederico, Sao Paulo-SP (BR)

( * ) Notice: Subject to any disclaimer, the term of this patent is extended or adjusted under 35 U.S.C. 154(b) by 0 days.

(21) Appl. No.: 18/264,472

(22) PCT Filed: Dec. 15, 2021

(86) PCT No.: PCT/BR2021/050552
§ 371 (c)(1),
(2) Date: Aug. 7, 2023

(87) PCT Pub. No.: WO2023/102623
PCT Pub. Date: Jun. 15, 2023

(65) Prior Publication Data

US 2024/0084586 A1 Mar. 14, 2024

(30) Foreign Application Priority Data

Dec. 7, 2021 (BR) ..... 20 2021 024704 0

(51) Int. Cl.
*E04B 2/18* (2006.01)
*E04B 2/02* (2006.01)

(52) U.S. Cl.
CPC ..... *E04B 2/18* (2013.01); *E04B 2002/0206* (2013.01); *E04B 2002/0236* (2013.01)

(58) Field of Classification Search
CPC ..... E04B 2/18; E04B 2002/0206; E04B 2002/0236; E04B 2/02; E04C 1/39
See application file for complete search history.

(56) References Cited

U.S. PATENT DOCUMENTS 2,957,278 A * 10/1960 Woodworth ..... E04B 2/14 52/316
4,320,612 A * 3/1982 Jeffries, Jr. ..... F27D 1/04 52/592.4

(Continued)

FOREIGN PATENT DOCUMENTS

BR MU8700558 U2 11/2008
BR 112019021073 A2 5/2020

(Continued)

OTHER PUBLICATIONS

International Search Report issued on Jan. 19, 2022, in corresponding International Patent Application No. PCT/BR2021/050552, 7 pages.

(Continued)

*Primary Examiner* — Rodney Mintz
(74) *Attorney, Agent, or Firm* — Maier & Maier, PLLC

(57) ABSTRACT

A modular block with four walls, a top face and two internal cavities, where both the locking and the centralization between the blocks are prominently made by male and female wedge-like couplings.

4 Claims, 15 Drawing Sheets

(56) References Cited

U.S. PATENT DOCUMENTS

| | | | | | |
|---|---|---|---|---|---|
| RE32,096 | E | * | 3/1986 | Jeffries, Jr. | F27D 3/123 52/592.4 |
| 5,024,035 | A | | 6/1991 | Hanson et al. | |
| 5,069,015 | A | * | 12/1991 | Steinwender | F27D 1/025 52/89 |
| 5,181,362 | A | * | 1/1993 | Benitez | E04B 2/18 52/591.1 |
| 5,355,647 | A | | 10/1994 | Johnson et al. | |
| 6,050,044 | A | * | 4/2000 | McIntosh | A63H 33/082 446/124 |
| 8,382,398 | B2 | * | 2/2013 | Stauffacher | E02B 3/108 405/111 |
| 8,495,850 | B1 | * | 7/2013 | Lin | A63H 33/086 446/124 |
| 8,893,450 | B2 | * | 11/2014 | Zohar | E04B 1/02 52/561 |
| 9,333,438 | B2 | * | 5/2016 | Lee | A63H 33/086 |
| D791,885 | S | * | 7/2017 | Rosan | D21/500 |
| 10,113,305 | B2 | * | 10/2018 | Radford | E04C 1/39 |
| 2007/0154265 | A1 | * | 7/2007 | Stauffacher | E02B 3/108 405/110 |
| 2013/0227901 | A1 | * | 9/2013 | Zohar | E04C 1/00 52/561 |
| 2015/0343320 | A1 | * | 12/2015 | Lee | A63H 33/086 446/120 |
| 2016/0194874 | A1 | * | 7/2016 | Radford | E04B 7/22 29/897.34 |
| 2017/0030069 | A1 | * | 2/2017 | Radford | A63H 33/04 |

FOREIGN PATENT DOCUMENTS

| | | | | |
|---|---|---|---|---|
| CN | 110528732 | A | 12/2019 | |
| CN | 111549969 | A | 8/2020 | |
| DE | 19633707 | A1 | 2/1998 | |
| DE | 19903287 | A1 | 8/1999 | |
| FR | 915121 | A | 10/1946 | |
| FR | 962843 | A | 6/1950 | |
| KR | 20210048447 | A | 5/2021 | |
| WO | 0177456 | A1 | 10/2001 | |
| WO | WO-2018184080 | A1 * | 10/2018 | E04B 2/02 |

OTHER PUBLICATIONS

Notice of Allowance issued on Jun. 6, 2022, in corresponding Brazilian application No. 20 2021 024704 0, 6 pages.

* cited by examiner

Seção A - A

ARRANGEMENT APPLIED TO MODULAR BLOCK WITH WEDGE-LIKE COUPLINGS

FIELD

The present application for patent refers to a novel ARRANGEMENT APPLIED TO MODULAR BLOCK WITH WEDGE-LIKE COUPLINGS, especially a hollow cobblestone block, made of polymer, the locking and centralization of which occurs by means of male and female wedge couplings of the side outer fillet in concordant profile recess located on the opposite wall, and also between the quadratic projections, on the top face, in at least eight inner single-wire braids, whereby enabling, by overlaying the blocks, to make a synthetic masonry assembly system used in any type of construction.

The field of application of the innovation now claimed is that of the construction industry, more specifically in the construction of synthetic masonry, without bonding elements, used in residential units, bus stops, schools, stores, etc.

BACKGROUND

The current state of the art anticipates some patent documents that address bricks and blocks endowed with couplings used in the construction of masonries, such as DE 19903287 A entitled "PROFILED HOLLOW BRICK"—refers to a brick to be stacked upon each other, comprising profiles that assist in locking when the parts are stacked. Cone-shaped profiles on the sides of the brick form male and female joints, and other cone-shaped profiles extend around the circular compartments, assisting in the centralization of the bricks.

By using cone-shaped profiles having a regular size (on the sides) the brick of the prior art above does not provide perfect locking between the parts, but solely a juxtaposition, and this fact should be offset, after assembling the masonry, by filling in the circular hollow compartments of the bricks with some material, such as, for example, light concrete, pumice stone, expanded clay, etc. Therefore, with the brick of the document cited above, it is possible to mount a wall using the couplings, but it is compulsory to complement it by filling in with material/subsequent filler.

MU 8700558-1 U2 entitled "ARRANGEMENT APPLIED TO BLOCKS USED IN CIVIL CONSTRUCTION"—refers to a block based on the "Lego" model for masonry construction, susceptible to assuming three arrangements, with one, two or three central square holes, the highlight of which is having two, three and four horizontal circular holes for the passage of pipelines and other facilities. Bordering each central hole there is a square base for laying the upper part, also being endowed with a fillet in high relief on the smaller-sized side, aligned with the circular bore, and low reliefs on the complementary wall. Both the square holes and the circular bores act as passage for reinforcement/ironwork.

The blocks of the prior art above only have male and female couplings, which do not offer safe/stable fastening by not promoting sufficient mechanical interference. So much so that the report states that after assembly, the masonry should be reinforced at least with plasterwork. Further, the relative positioning of the high and low relief obliges the use of certain arrangements of blocks so that the couplings coincide, which also limits the constructive system.

BR 112019021073-3 entitled "MODULAR BLOCK FOR ASSEMBLING PASSAGE BOX"—consists of a single cobblestone block endowed with a square male fitting having a central bore for the passage of locking tether on the top face, which faces a female fitting, also square, on the inner face of the part, which, together, are for overlaying and juxtaposing the blocks; which keep a laterality thanks to the male couplings represented by a prismatic appendix and a female fitting represented by a slot on the side and opposite side faces; the block is complemented by a locking extension that prevents the entry of residues inside the box when mounted on the frames.

The block of the prior art above does not promote perfect locking on the side walls, as same is implemented by fitting the appendix in the slot, there being no type of interference. Even the centralization of the block, when laid over the parts, is not effective because despite being wedge-like, it has a reduced contact area, which leaves room for kinks, in detriment to the stability of the masonry.

SUMMARY

It is an objective of the present innovation to propose a modular block capable of promoting effective connection both in locking and centralizing, thanks to the male and female wedge-like fitting, the fastening of which increases according to the intensity of the strength attributed in the coupling.

It is an objective of the present innovation to propose a modular block which after assembling the masonry does not require filling with a bonding element.

It is an objective of the present innovation to propose a modular block capable of providing a constructive system that is fast, versatile and highly maneuverable, susceptible for being applied, for example, in residences, at bus stops, bank branches, health clinics and others.

It is an objective of the present innovation to propose a modular block having optimal cost×benefit ratio.

The "ARRANGEMENT APPLIED TO MODULAR BLOCK WITH WEDGE-LIKE COUPLINGS" consists of a cobblestone block having male and female wedge-like couplings both on the smaller-sized side walls, represented by fillet and recess, and by quadratic projections, on the top face, which take place in the internal cavities where they contact at least eight ramped single-wire braids, whereby enabling the firm and cohesive assembly of masonries, without the need for binding means, applicable to different constructions.

BRIEF DESCRIPTION OF THE DRAWINGS

The drawings set out below are for improved explanation of the patent application in an illustrative and non-limitative manner.

DETAILED DESCRIPTION OF THE EMBODIMENTS

Figure 1:
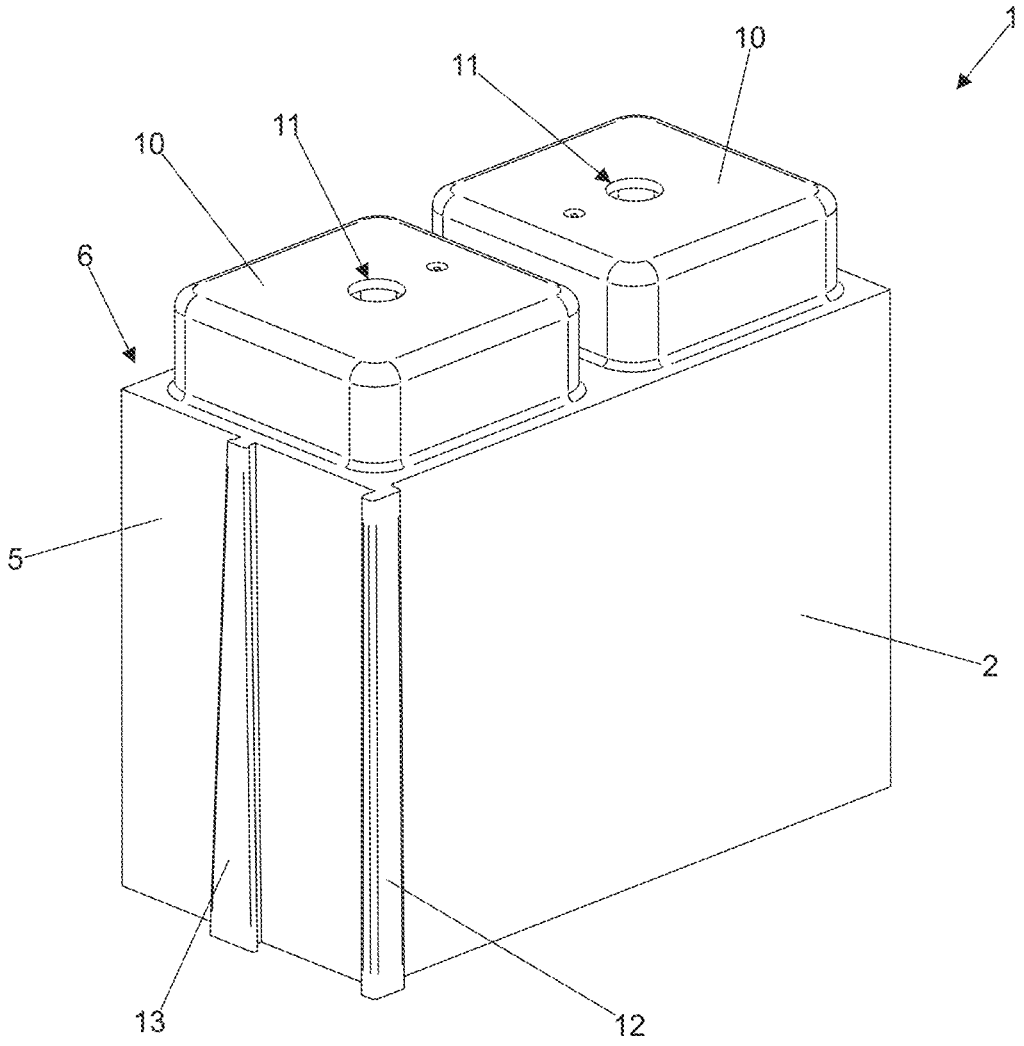
FIG. 1: Perspective view of the arrangement applied to modular block with wedge-like couplings.
Figure 2:
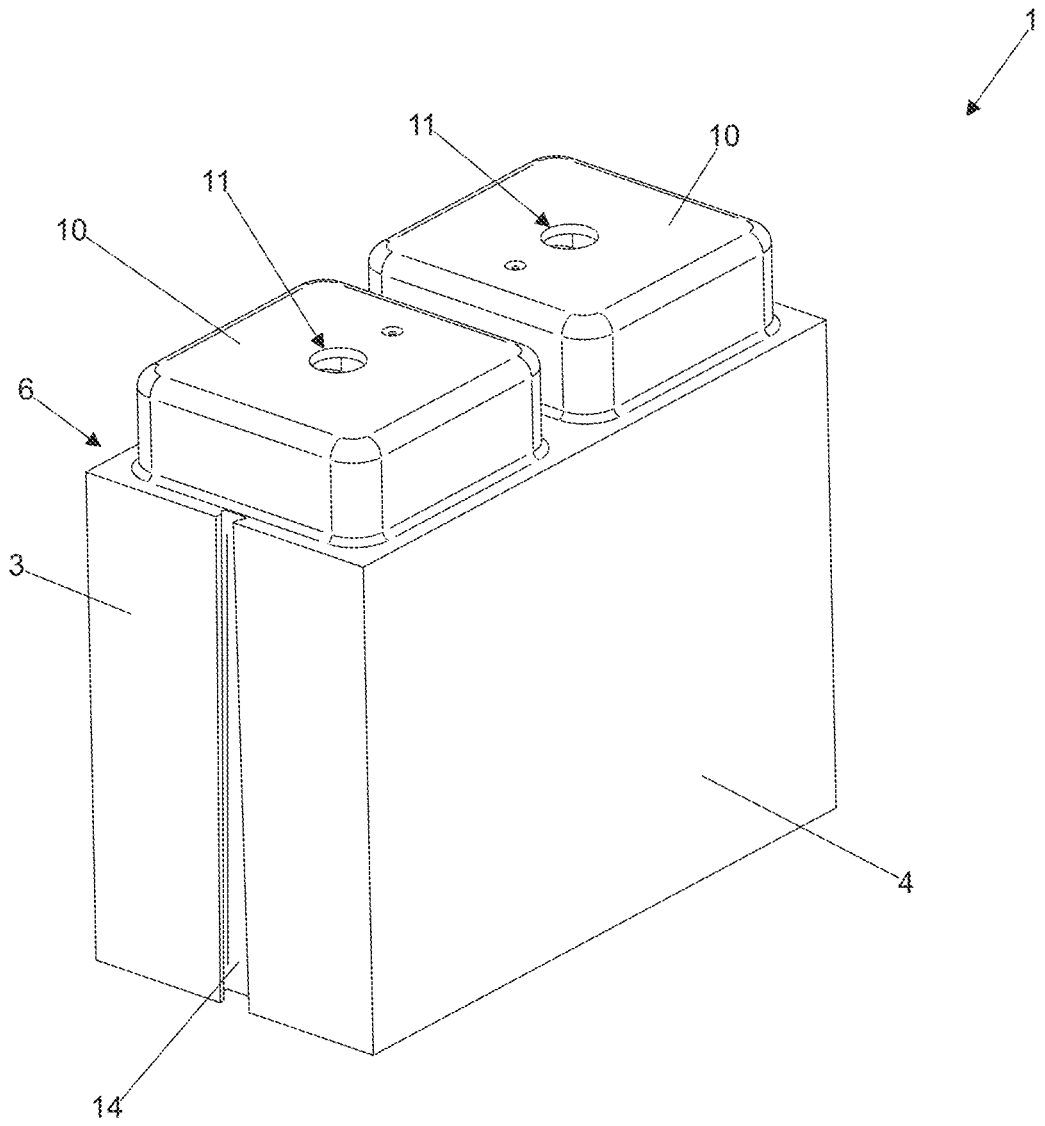
FIG. 2: Inverted perspective view of the arrangement applied to modular block with wedge-like couplings.
Figure 3:
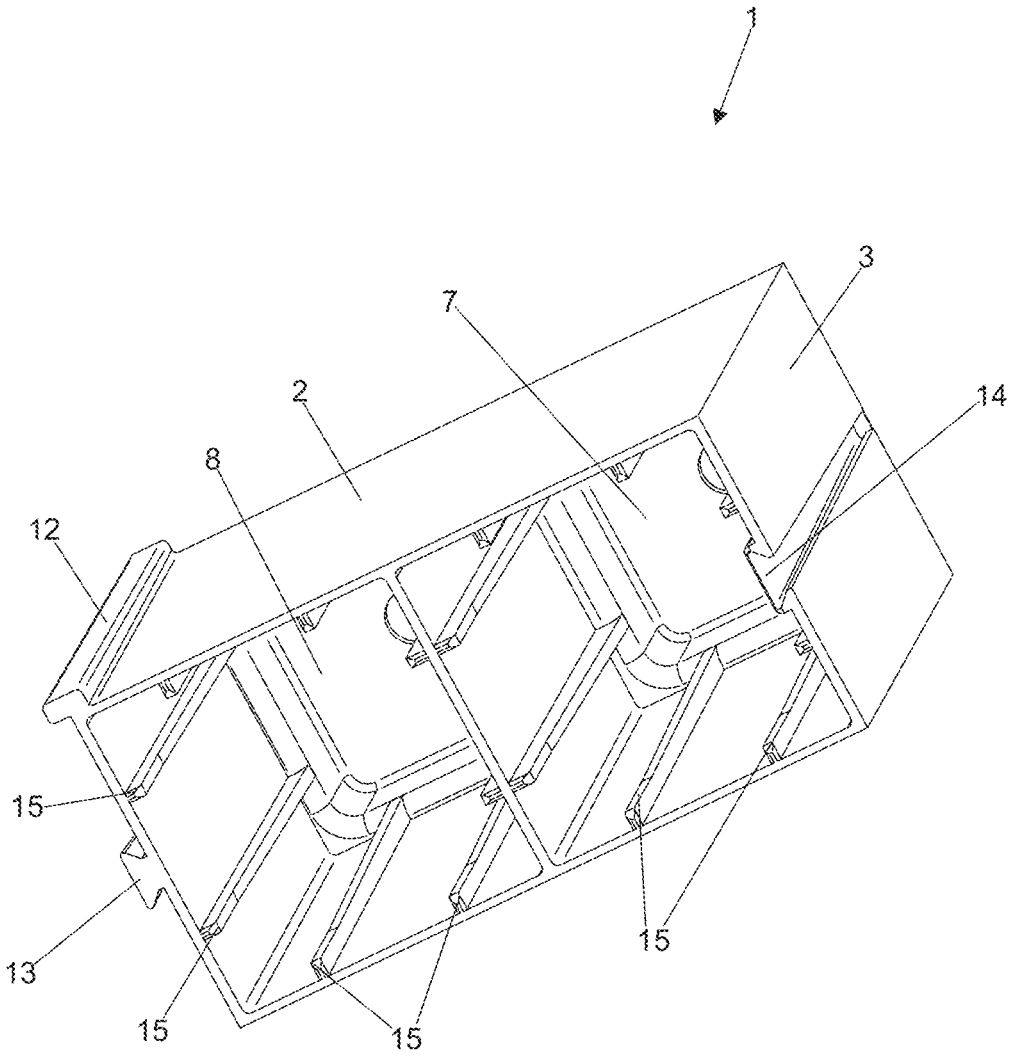
FIG. 3: Bottom perspective view of the arrangement applied to modular block with wedge-like couplings.
Figure 4:
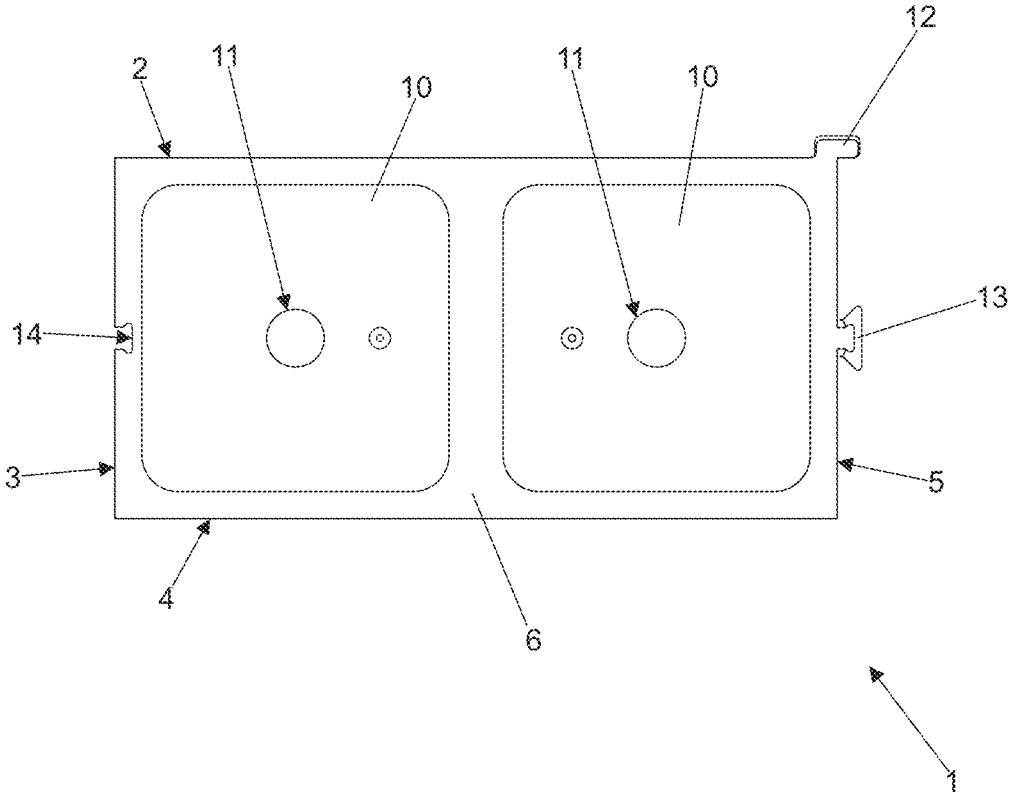
FIG. 4: Top view of the arrangement applied to modular block with wedge-like couplings.
Figure 5:
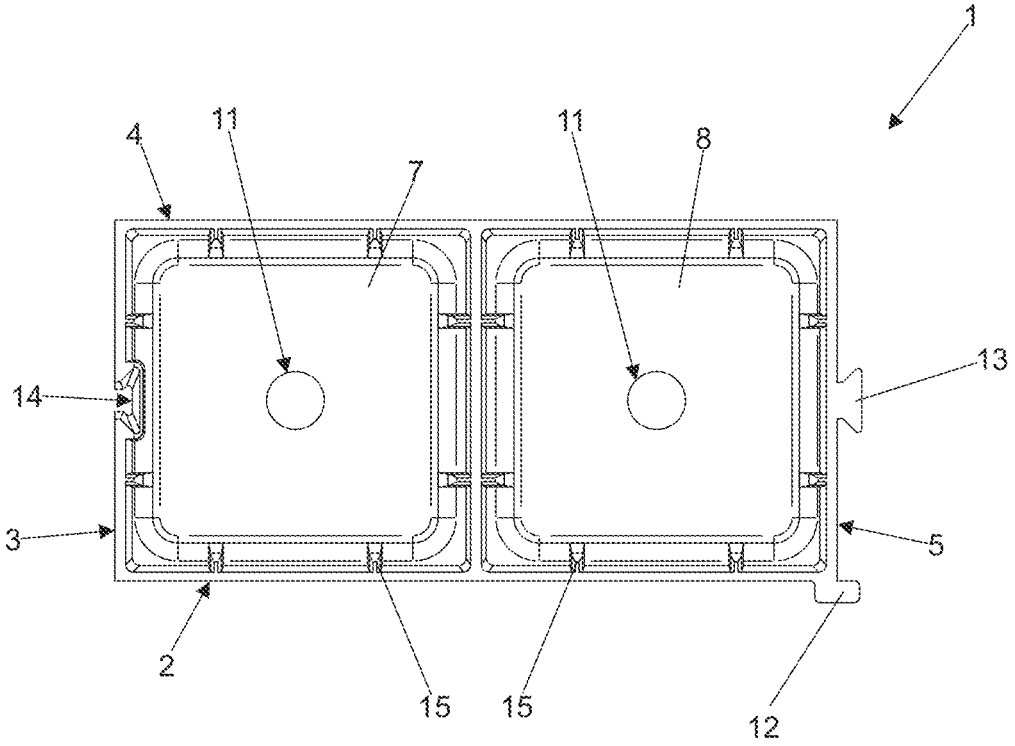
FIG. 5: Bottom view of the arrangement applied to modular block with wedge-like couplings.
Figure 6:
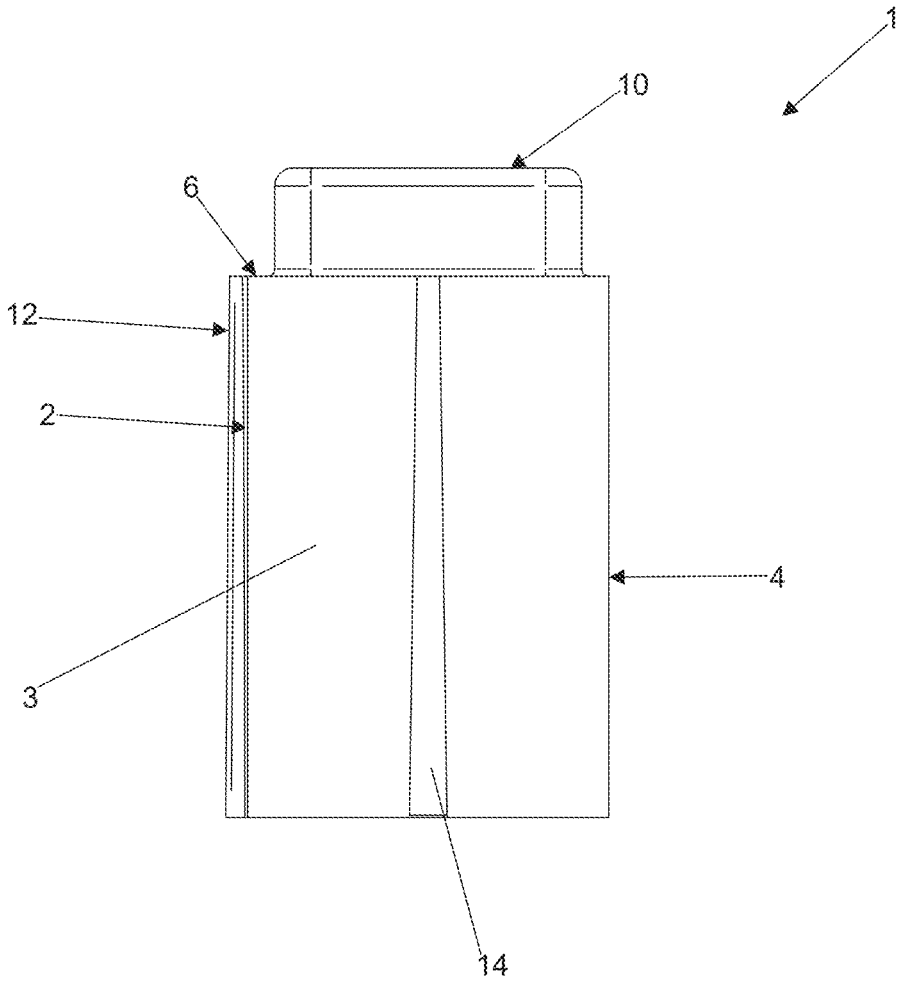
FIG. 6: Side view of the arrangement applied to modular block with wedge-like couplings.
Figure 7:
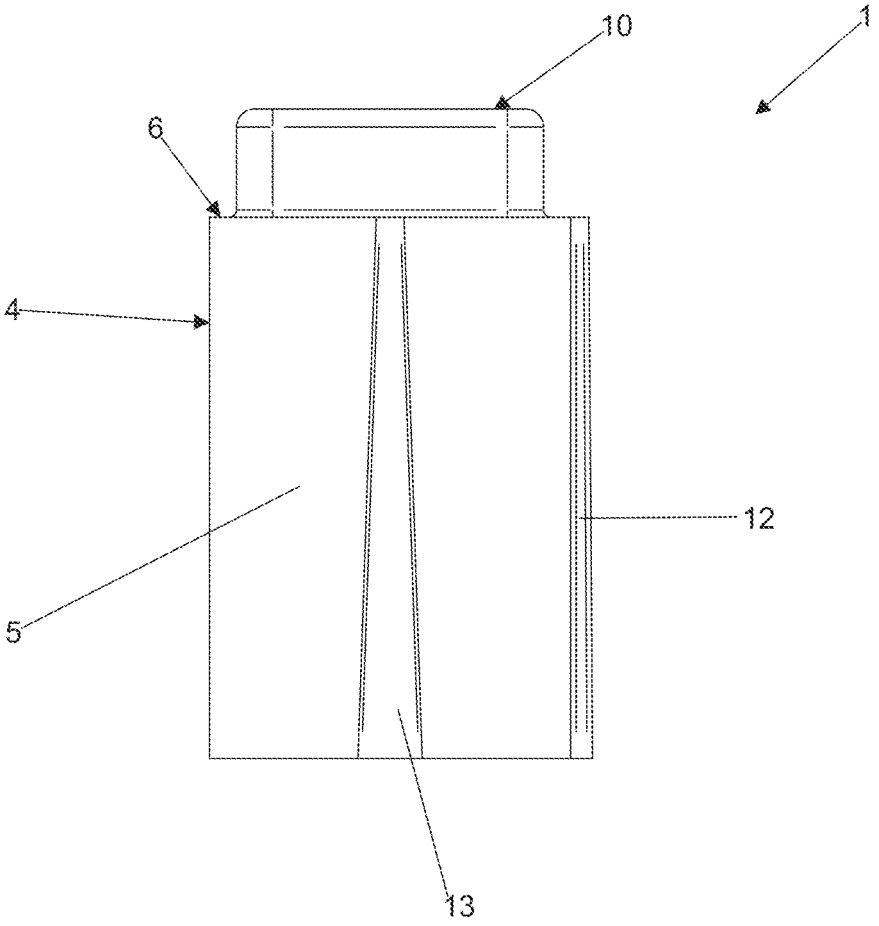
FIG. 7: Opposite side view of the arrangement applied to modular block with wedge-like couplings.
Figure 8:
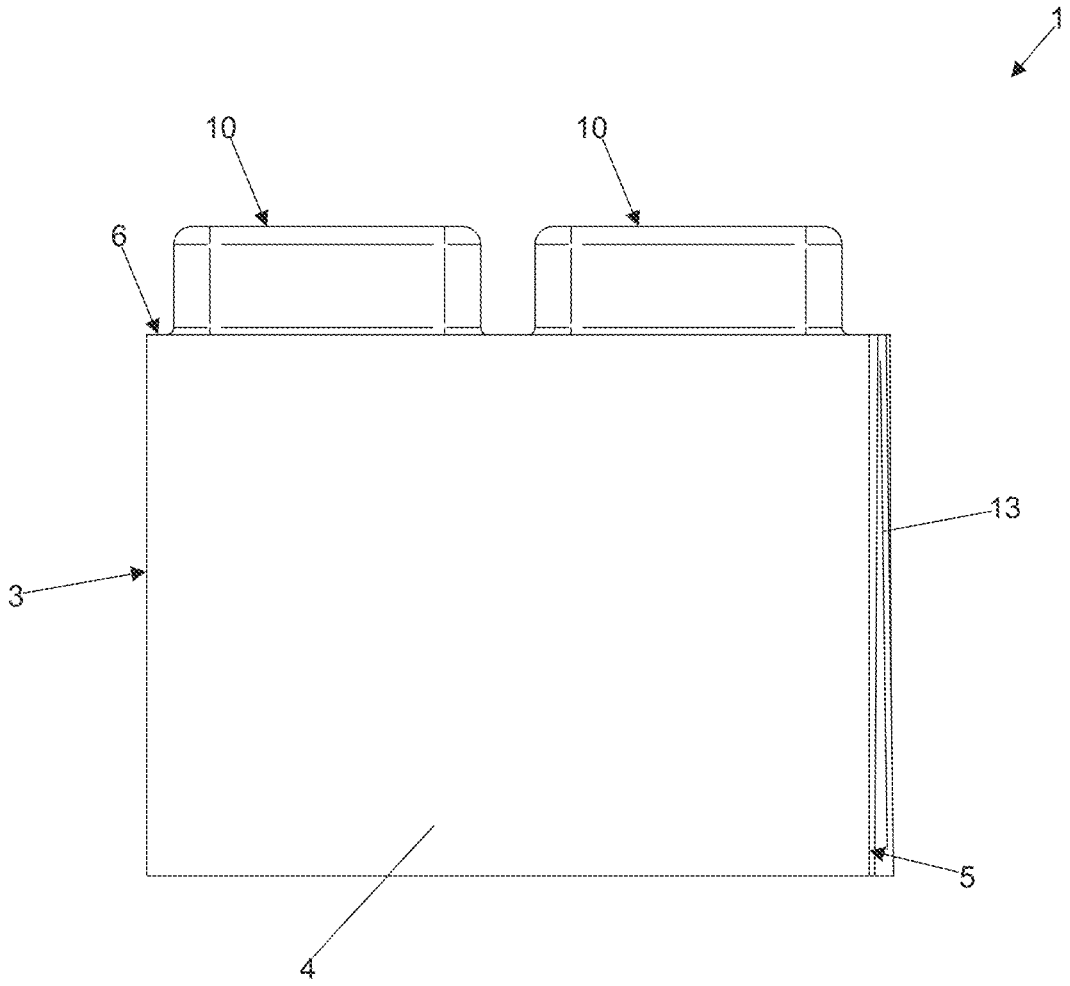
FIG. 8: Front view of the arrangement applied to modular block with wedge-like couplings.
Figure 9:
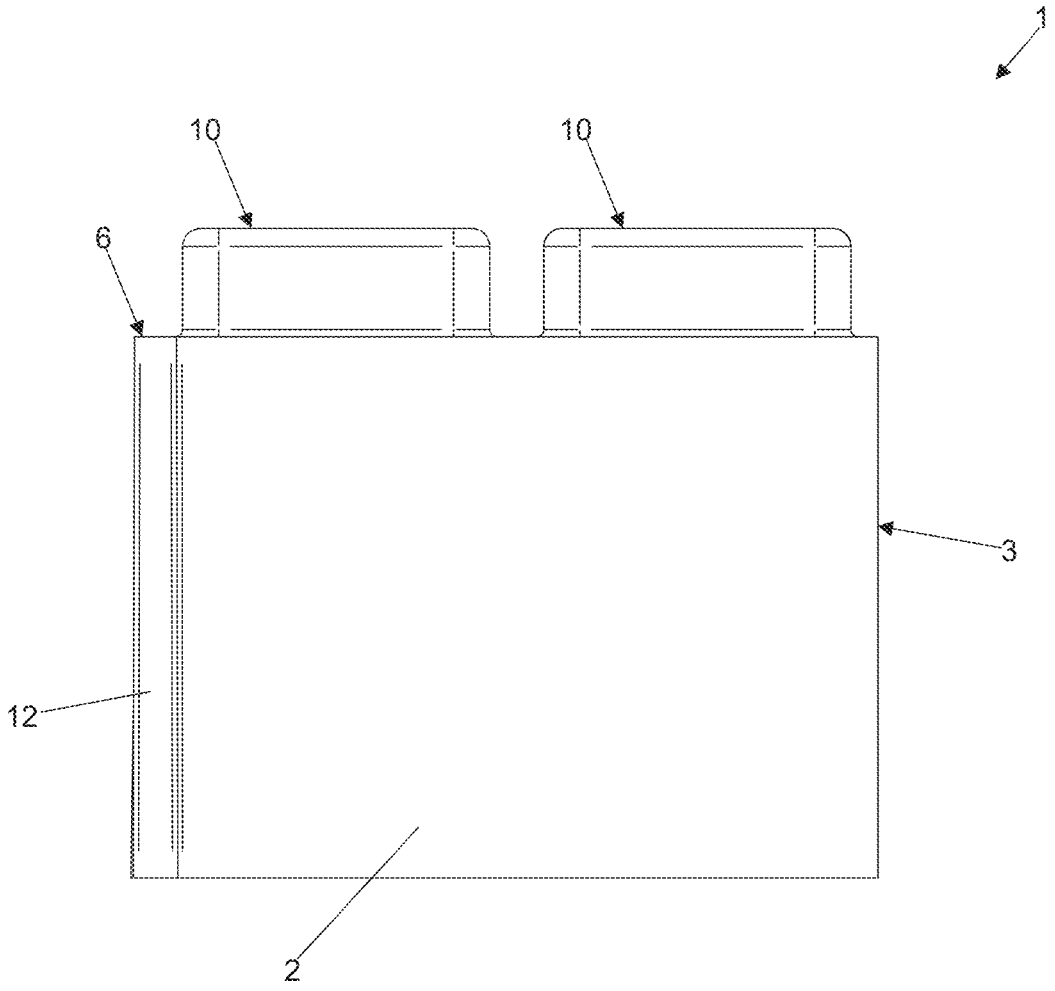
FIG. 9: Rear view of the arrangement applied to modular block with wedge-like couplings.
Figure 10:
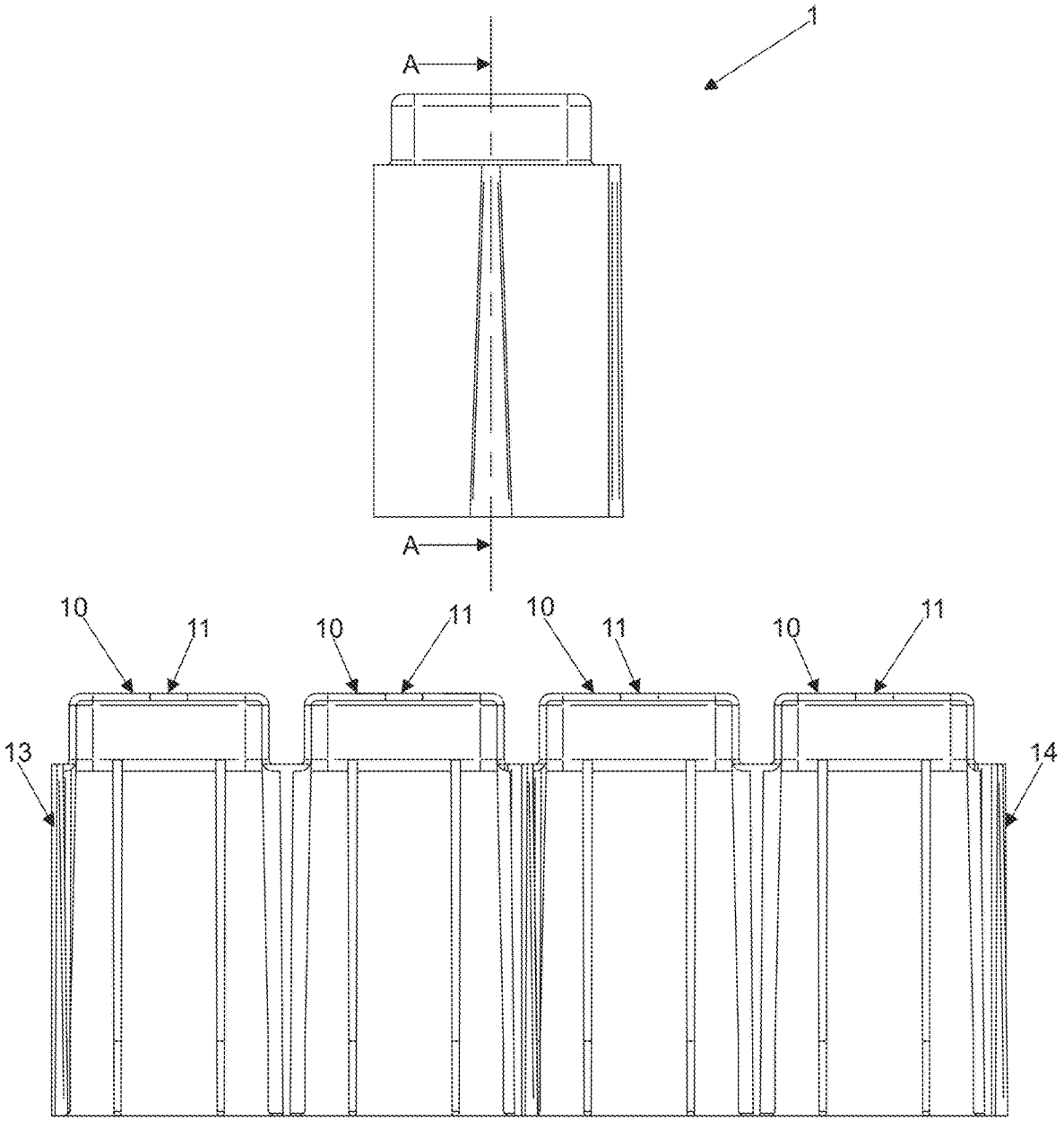
FIG. 10: Cutaway perspective view showing the couplings of the blocks in use.
Figure 11:
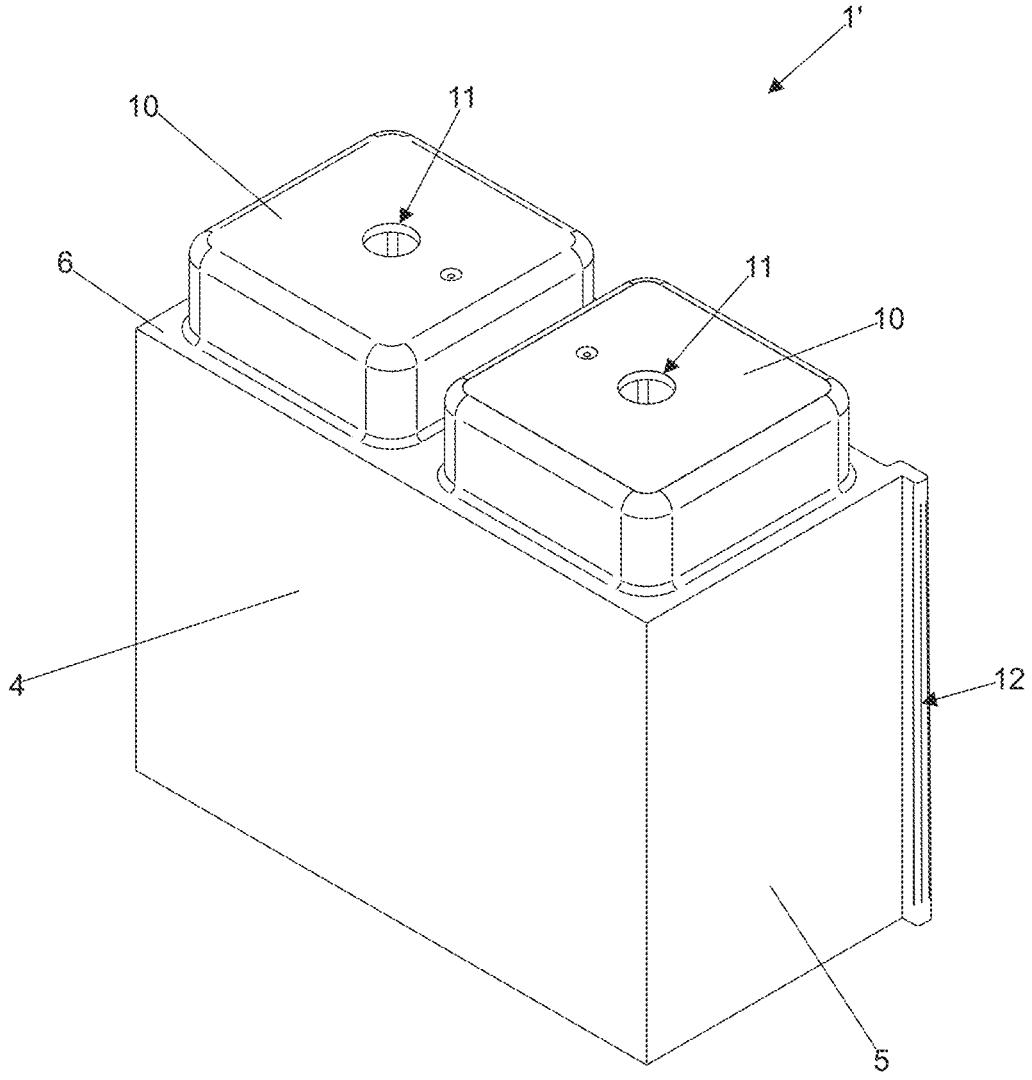
FIG. 11: Perspective view of the arrangement applied to modular block with wedge-like couplings, in a variation used in the corner of the masonry.
Figure 12:
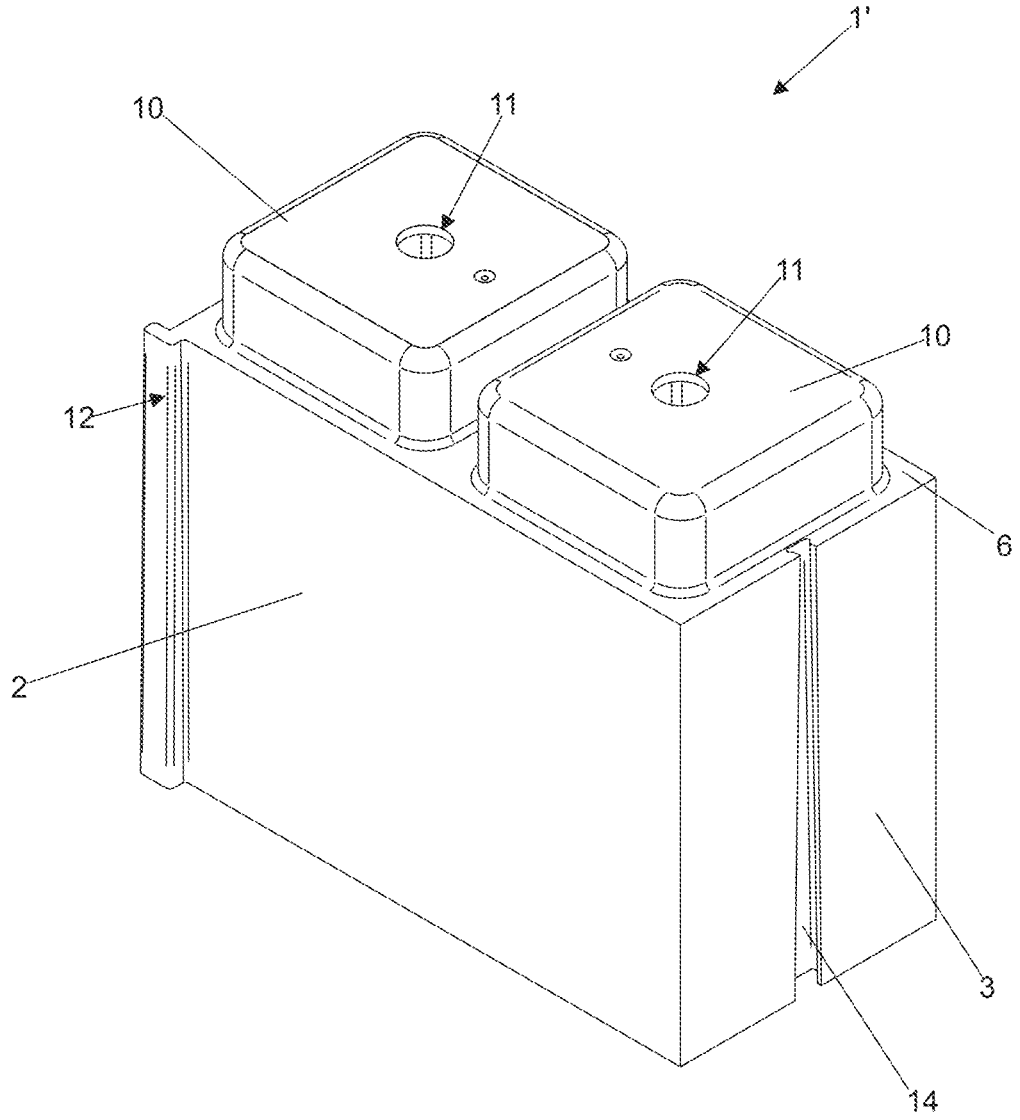
FIG. 12: Inverted perspective view of the arrangement applied to modular block with wedge-like couplings, in a variation used in the corner of the masonry.
Figure 13:
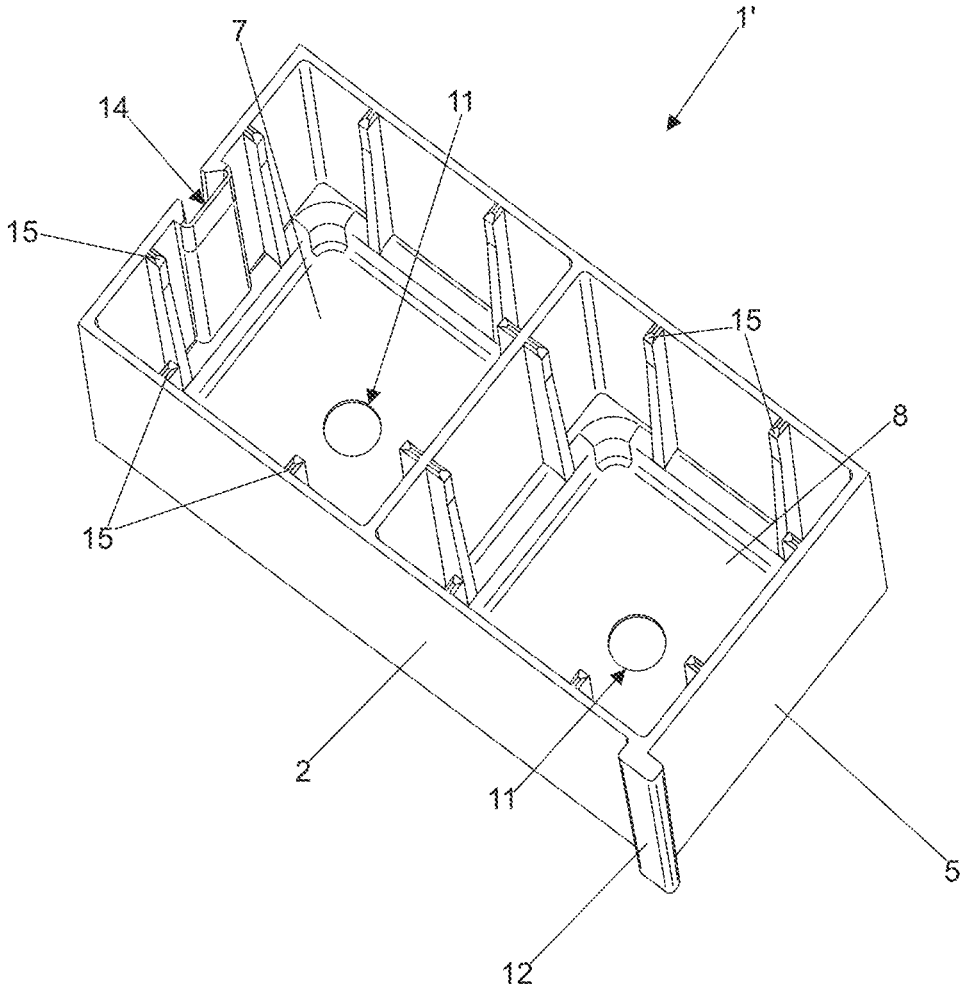
FIG. 13: Bottom perspective view of the arrangement applied to modular block with wedge-like couplings, in a variation used in the corner of the masonry.
Figure 14:
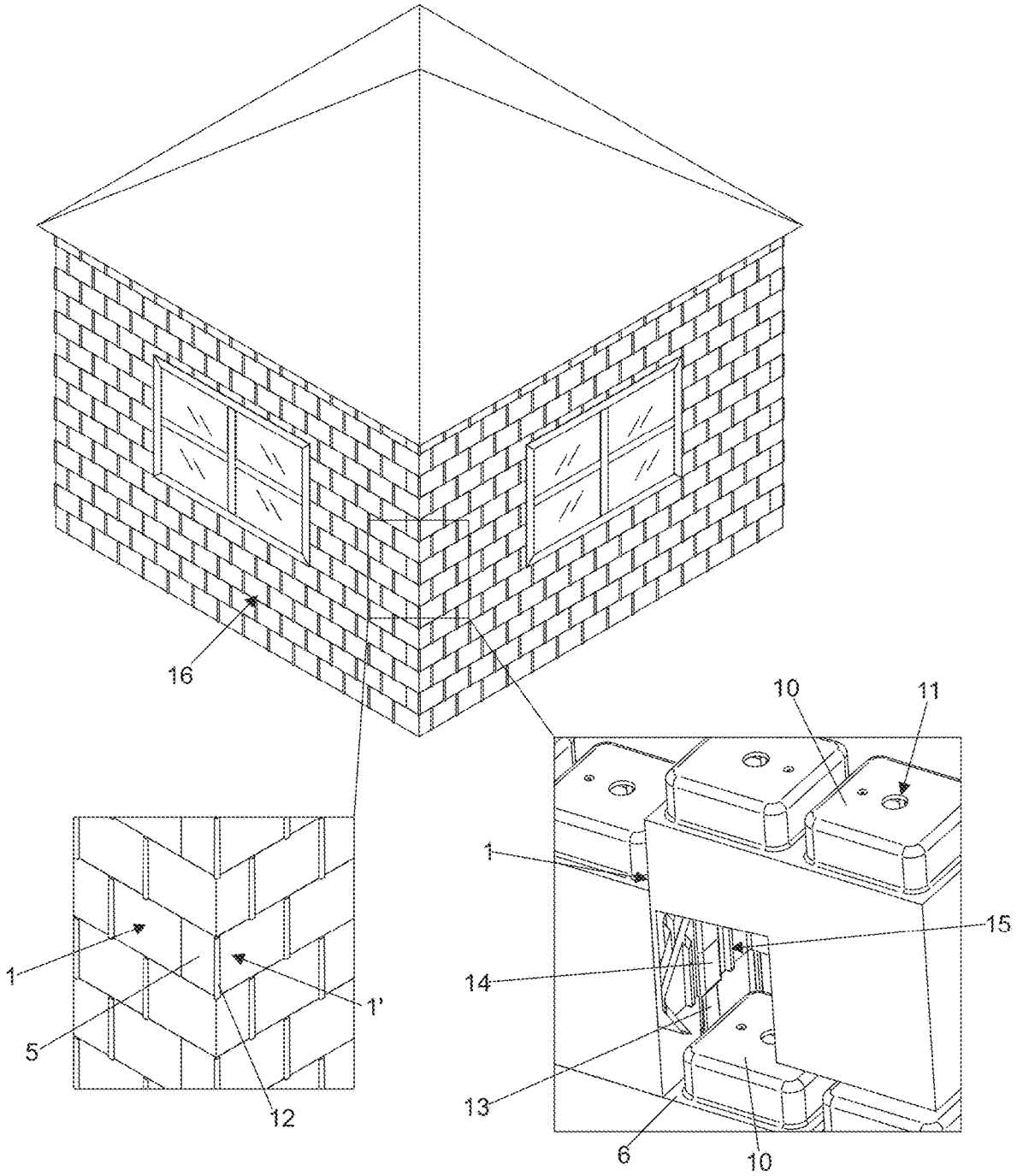
FIG. 14: Perspective view of the arrangement applied to modular block with wedge-like couplings applied to a residence, with a blown-up detail of the joint of the corner block.
Figure 15:
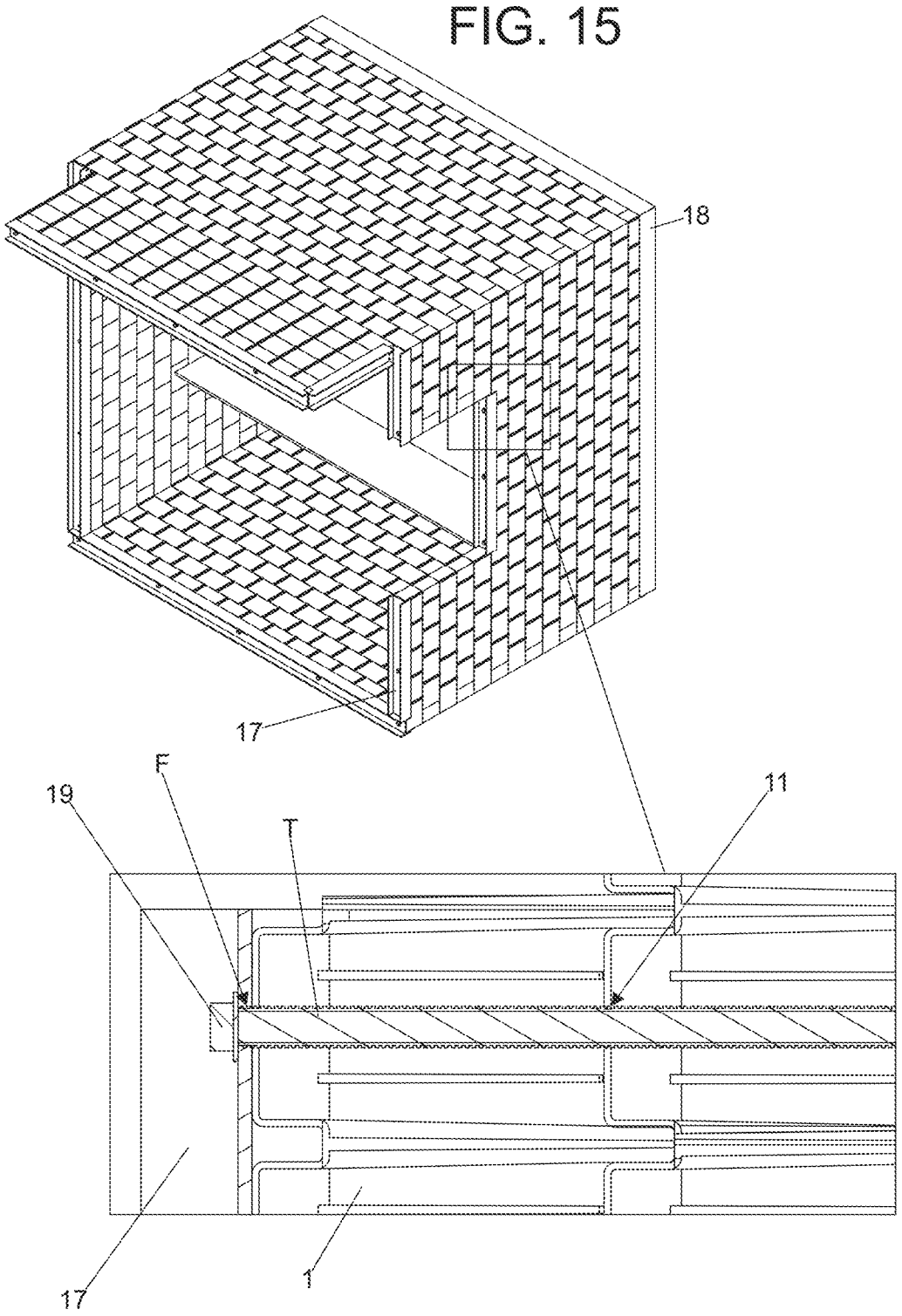
FIG. 15: Perspective view of the arrangement applied to modular block with wedge-like couplings applied to a bus stop, with cutaway detail of the tether, blocks and frames.

The ARRANGEMENT APPLIED TO MODULAR BLOCK WITH WEDGE-LIKE COUPLINGS, object of this patent application, consists of a modular block (1) endowed with four walls (2, 3, 4, 5), an top face (6) and two internal cavities (7, 8) wherein both the locking and centralization between the blocks (1) are prominently implemented by male and female wedge-like couplings.

More particularly, the innovation consists of a hollow cobblestone modular block (1), made of polymer, endowed with four walls (2, 3, 4, 5), an top face (6) and two internal cavities (7, 8) separated by a partition (9), and on the top face (6) two quadratic projections (10) are prominently juxtaposed with a central bore (11) for the passage of tethers (T) used in the constructive system, whereas on the side between the walls (2 and 5) there is a vertical extension (12) that prevents the entry of residues from that point inwardly when at least two blocks (1) are joined. Both the locking and the centralization between the blocks (1) are made by male and female wedge-like couplings, such that the more pressure there is between said blocks (1) the greater the fastening achieved. On the face of the wall (2) there is a fillet (13) with trapezoidal cross-section increasing in size from the end to the base of the block (1), which acts as guide for a compatible recess (14), having the same cross-section and design, located on the face of the wall (3), that when duly inserted carries through the locking between the blocks (1) with the male and female wedge-like fitting, wherein the fillet (13) is the male part and the recess the female part of said fitting. Each of the internal cavities (7, 8) has a pair of single-wire braids (15), on each of their four wedge-shaped faces, positioned so as to receive the quadratic projections (10) generating a mechanical interference deriving from the male and female wedge-like fitting, wherein said quadratic projections (10) are the male part and the internal cavities (7, 8) and respective braids (15) the female part. Accordingly, when overlaid the blocks are centralized.

A constructive variation of the hollow cobblestone modular block (1'), made of polymer has a smooth wall (5), that is, without the fillet (13) being used to finalize the assembly on the corners of the masonries (16).

The blocks (1) duly juxtaposed and overlaid used in assembling the masonries (16) supported on a primary frame (17) and a complementary frame (18), all the parts having through-passing tethers (T) concentric to the bores (11) of the blocks and holes (F) of the tethers per se fixed by a fastening element, such as, for example, a nut (19) susceptible to application in any type of construction such as, for example, residences and bus stops.

The present innovation now proposed is intended to encompass all alternatives and variations, modifications and equivalents that can be included in the measurements and shapes of this block when not perceivably straying from the inventive concept proposed.

The invention claimed is:

1. A system comprising:

a plurality of hollow modular blocks composed of polymer, each modular block comprising: four walls, a top face and two internal cavities separated by a partition, and, on the top face, two quadratic projections extending above the top face are prominently juxtaposed each with a central bore for passage of tethers used in assembling, wherein the four walls have a common height each from a base thereof to a top thereof joined to the top face, and wherein the four walls comprise a first wall, a second wall adjacent and perpendicular to the first wall, a third wall adjacent and perpendicular to the second wall and parallel to the first wall, and a fourth wall adjacent and perpendicular to each of the third wall and first wall and parallel to the second wall; a vertical extension located along a vertical junction of an exterior of the first wall and an exterior of the second wall, the vertical extension projecting outwardly therefrom and completely extending the common height, wherein, in an assembled configuration, the second wall of a first modular block of the plurality of blocks is laterally joined with a side-adjacent block of the plurality of blocks such that the vertical extension of the first modular block prevents entry of residues inwardly thereof; a fillet completely extending the common height along the exterior of the second wall from the base of the second wall to the top of the second wall, the fillet having a trapezoidal horizontal cross section narrowing from the base of the second wall to the top of the second wall; and a recess completely extending the common height along an exterior of the fourth wall from the base of the fourth wall to the top of the fourth wall without defining an opening therethrough, the recess having a matching trapezoidal horizontal cross section narrowing from the base of the fourth wall to the top of the fourth wall.

2. The system according to claim 1, wherein the exterior of the first wall and an exterior of the third wall are smooth.

3. The system according to claim 1, wherein the partition connects internal sides of the first wall and the third wall.

4. The system according to claim 1, wherein:

the partition comprises, along a first side thereof facing into a first of the two internal cavities and facing an interior of the second wall, a spaced pair of fittings each extending vertically and each generating, in the assembled configuration of the first modular block vertically joined with a lower vertically adjacent block of the plurality of blocks, a mechanical interference with a quadratic projection of the lower vertically adjacent block;

the second wall comprises, along the interior thereof facing into the first of the two internal cavities and facing the partition, a spaced pair of fittings each extending vertically and each generating, in the assembled configuration of the first modular block vertically joined with the lower vertically adjacent block, a mechanical interference with the quadratic projection of the lower vertically adjacent block;

the first wall comprises, along a first interior portion thereof adjacent the first side of the partition and facing into the first of the two internal cavities, a spaced pair of fittings each extending vertically and each generating, in the assembled configuration of the first modular block vertically joined with the lower vertically adjacent block, a mechanical interference with the quadratic projection of the lower vertically adjacent block; and the third wall comprises, along a first interior portion thereof adjacent the first side of the partition and facing into the first of the two internal cavities, a spaced pair of fittings each extending vertically and each generating, in the assembled configuration of the first modular block vertically joined with the lower vertically adjacent block, a mechanical interference with the quadratic projection of the lower vertically adjacent block.

* * * * *